US007466835B2

(12) United States Patent
Stenberg et al.

(10) Patent No.: US 7,466,835 B2
(45) Date of Patent: Dec. 16, 2008

(54) MINIATURE MICROPHONE WITH BALANCED TERMINATION

(75) Inventors: Lars Jørn Stenberg, Roskilde (DK); Matthias Müllenborn, Lyngby (DK); Igor Mucha, Bratislava (SK)

(73) Assignee: Sonion A/S, Roskilde (DK)

( * ) Notice: Subject to any disclaimer, the term of this patent is extended or adjusted under 35 U.S.C. 154(b) by 590 days.

(21) Appl. No.: 10/802,803

(22) Filed: Mar. 18, 2004

(65) Prior Publication Data

US 2004/0202345 A1 Oct. 14, 2004

(51) Int. Cl.
*H04R 25/00* (2006.01)

(52) U.S. Cl. ..... 381/174; 381/175; 381/369

(58) Field of Classification Search ..... 381/113, 381/116, 120, 174, 175, 191, 173, 369; 367/170, 367/173, 181, 188; 29/25.41, 594; 307/400; 438/52; 257/698

See application file for complete search history.

(56) References Cited

U.S. PATENT DOCUMENTS

| | | | | |
|---|---|---|---|---|
| 3,778,561 A * | 12/1973 | Reedyk | ..... | 381/113 |
| 5,097,224 A | 3/1992 | Madaffari et al. | | |
| 5,130,666 A | 7/1992 | Nicollini | | |
| 6,088,463 A | 7/2000 | Rombach et al. | | |
| 6,522,762 B1 * | 2/2003 | Mullenborn et al. | ..... | 381/174 |
| 6,593,870 B2 * | 7/2003 | Dummermuth et al. | ..... | 341/155 |
| 6,785,393 B2 * | 8/2004 | Lipponen et al. | ..... | 381/191 |

FOREIGN PATENT DOCUMENTS

| | | | |
|---|---|---|---|
| DE | 3413145 | A1 | 10/1985 |
| DE | 19547195 | A1 | 6/1997 |
| WO | WO 00/70630 | | 11/2000 |
| WO | WO 01/19133 | A1 | 3/2001 |
| WO | WO 01/19134 | A2 | 3/2001 |

* cited by examiner

*Primary Examiner*—Huyen D Le
(74) *Attorney, Agent, or Firm*—Harness, Dickey & Pierce, P.L.C.

(57) ABSTRACT

The present invention provides a miniature MEMS microphone comprising a single-ended transducer element connected to an amplifier providing a differential electrical output at terminals arranged at a substantially plane exterior surface. The differential or balanced output signal provides a miniature microphone exhibiting a high dynamic range and a reduced susceptibility to EMI. The microphone is adapted for surface mounting thus the extra output terminal required is still suitable for low cost mass production. In preferred embodiments the transducer element and amplifier are silicon-based. The microphone may have a plurality of separate single-ended transducer elements connected to separate amplifiers providing separate differential outputs. The microphones according to the invention are advantageous for applications within for example hearing aids and mobile equipment.

10 Claims, 2 Drawing Sheets

MINIATURE MICROPHONE WITH BALANCED TERMINATION

FIELD OF THE INVENTION

The present invention relates to the field of miniature microphones. In particular, the present invention relates to miniature MEMS microphones with a high dynamic range while still suitable for low cost mass production.

BACKGROUND OF THE INVENTION

Practically all miniature consumer applications such as hearing aids, mobile phones and similar require microphone assemblies with still larger dynamic range in combination with still smaller size and a low electromagnetic interference (EMI) sensitivity. Smaller size also means a reduced power supply voltage which contradicts the demand for larger dynamic range.

U.S. Pat. No. 6,088,463 describes a silicon-based miniature microphone assembly. It is mentioned, column 3, fines 36-40, that it is possible to produce an embodiment with a diaphragm arranged between two backplates. This may be seen as advantageous in relation to suppress EMI, however, U.S. Pat. No. 6,088,463 does not teach an intention of providing a microphone assembly with a wide dynamic range.

DE 34 13 145 A1 published in 1985, describes an electret condenser microphone assembly suited for replacing a dynamic microphone in a telephone handset. In an embodiment the microphone assembly has a differential electret condenser microphone connected to a differential FET-based preamplifier providing a differential output.

U.S. Pat. No. 6,088,463 is complicated to produce due to the symmetrical diaphragm structure and it does not solve the dynamic range problem. DE 34 13 145 A1 provides a balanced output signal thus providing a high dynamic range. However, the balanced output requires an extra output terminal and thus the solution is unsuitable for miniaturisation in low cost mass production since extra terminals require space and the manufacturing process becomes more complicated and time consuming.

Therefore, it may be seen as an object of the present invention to provide a miniature microphone assembly with an increased dynamic range. The provided microphone assembly should be suitable for low cost production.

SUMMARY OF THE INVENTION

The above mentioned object is complied with by providing a miniature Micro-Electro-Mechanical System (MEMS) microphone comprising

- a single-ended transducer element adapted to receive incoming acoustic waves and to convert a received incoming acoustic wave to an unbalanced first electrical signal, and
- an amplifier adapted to receive the first electrical signal, and to generate a differential electrical signal being an amplified version of the first electrical signal, and to provide said differential electrical signal on a pair of terminals arranged on a substantially plane exterior surface part of the miniature MEMS microphone.

The single-ended transducer element may be mounted on a first surface of a silicon-based carrier substrate, wherein a second surface of the silicon-based carrier substrate forms the substantially plane exterior surface part. Preferably the first surface is substantially plane and substantially parallel to the second surface.

The amplifier may be mounted on the first surface of the silicon-based carrier substrate, or the amplifier may be monolithically integrated with the silicon-based carrier substrate.

Preferably, the single-ended transducer element is silicon-based, and preferably the amplifier is formed on a silicon-based substrate.

The single-ended transducer and the amplifier may be integrated on a silicon-based substrate.

The miniature MEMS microphone may further comprise a housing having an acoustical inlet opening aligned with the single-ended transducer element.

In an embodiment the miniature MEMS microphone comprise a plurality of single-ended transducer elements adapted to generate unbalanced electrical signals in response to incoming acoustic waves, each of the plurality of unbalanced electrical signals being received by separate amplifiers adapted to provide differential amplified versions of the plurality of unbalanced electrical signals on separate pairs of terminals arranged on the substantially plane exterior surface of the miniature MEMS microphone.

Due to the differential principle a 3 dB increase in dynamic range is obtained, and in addition the differential output signal is less susceptible to EMI. A conventional single-ended transducer element is advantageous with respect to low cost mass production. The MEMS technology provides an easy surface mounting process thus reducing the disadvantages that the balanced output signal of the microphone requires an extra output terminal compared to traditional unbalanced designs.

BRIEF DESCRIPTION OF DRAWINGS

Below, the present invention is described in more details with reference to the accompanying figures, wherein.

Figure 1:
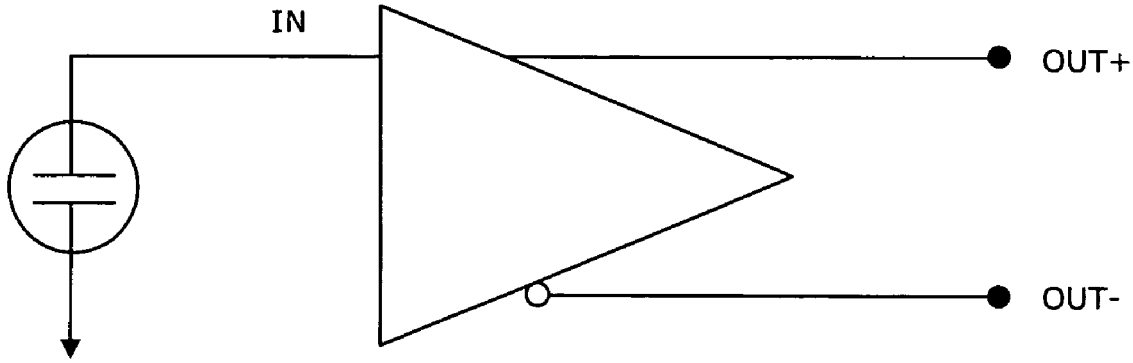
FIG. 1 shows an electric diagram illustrating the principle of the miniature microphone according to the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

FIG. 1 shows an electric diagram illustrating the principle of interconnecting and terminating a miniature MEMS microphone according to the present invention. The microphone comprises a single-ended microphone transducer element and an amplifier providing a differential output on terminals OUT+ and OUT−. The single-ended transducer element may be a conventional electret condenser microphone or it may be a silicon-based condenser microphone. This means that the internal connections within the microphone assembly will not benefit from the balancing principle with respect to with reduced susceptibility to electromagnetic interference (EMI). However, the principle can be applied even with a traditional transducer element. Only the preamplifier needs to be adapted for providing a differential output.

Since the MEMS microphone can be produce with very small dimensions it is possible to minimise the distance between the transducer element and the amplifier thus the minimising the unbalanced signal path therebetween. With respect to low cost mass production the single-ended transducer element is advantageous compared to the complicated process of manufacturing a symmetrical transducer element capable of providing a balanced output to the amplifier.

It should be noted that the electrical connections shown in FIG. 1 are only interconnections relevant with respect to the signal interconnection. Therefore, connections originating from e.g. bias voltage circuitry of the microphone cartridge and power supply connections of the amplifier are not shown in FIG. 1.

Figure 2:
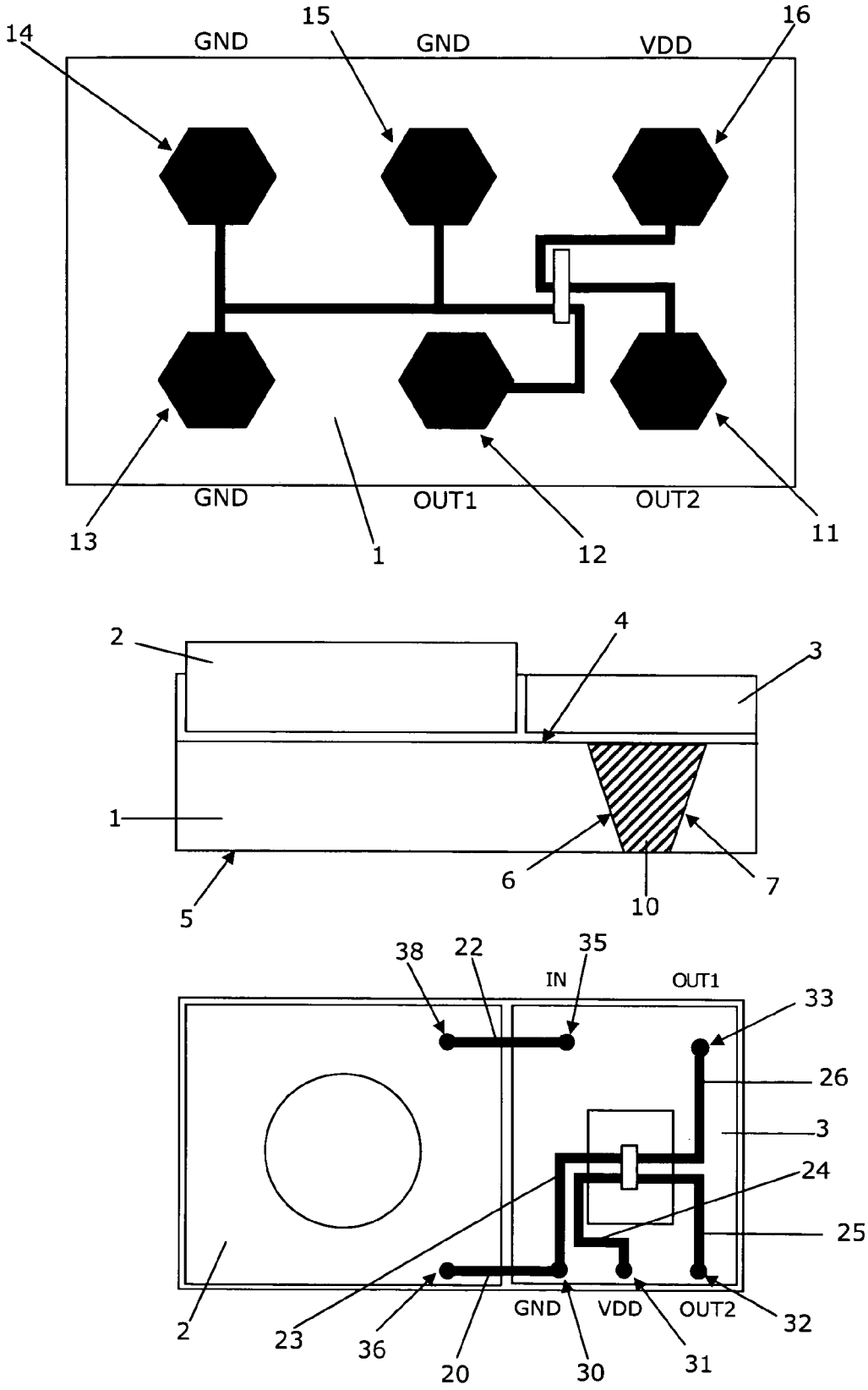
FIG. 2 shows an example of the terminal and interconnection layout of an embodiment of the miniature MEMS microphone comprising a silicon microphone mounted integrated with an ASIC.

FIG. 2 illustrates an embodiment according to the invention, e.g. a single-ended microphone transducer element coupled to a differential amplifier. A miniature MEMS microphone assembly is shown, from the top of FIG. 2: in bottom view, in side view and in top view. The side view of FIG. 2 shows a silicon-based carrier substrate 1 with a silicon-based miniature transducer element 2 surface mounted on a first surface 4 of the silicon carrier substrate 1. The transducer element cartridge 2 is connected and fixed by solder bumps 36,37,38. The carrier substrate 1 is bulk crystalline silicon, and it has one or more vertical etched feed-through holes 10 with vertical electrical feed-through lines 6,7 (locations of 6,7 indicated but lines are not visible in the drawings) connecting solder bumps 30,31,32,33 on the first surface 4 with solder bumps or pads 11-16 on a second surface 5 of the carrier substrate 1. The solder bumps or pads 11-16 on the second surface 5 of the carrier substrate 1 are adapted for terminating the miniature MEMS microphone, e.g. electrically connecting the microphone with external equipment.

An ASIC 3 comprising a differential amplifier is flip-chip mounted onto the silicon carrier substrate 1. The ASIC 3 is connected and fixed by solder bumps 30-35. An electrical interconnection between the transducer element 2 and the amplifier ASIC 3 is unbalanced and it is formed by the connectors 20, 22 on the first surface 4 of the carrier substrate 1. The connectors 20, 22 are indicated on the top view of FIG. 2: ground (indicated as GND) 20, and input (indicated as IN) 22. The connectors 20, 22 electrically connect solder bumps 30, 35 on an ASIC part of the carrier substrate 1 and solder bumps 36, 38 on a microphone part of the carrier substrate 1, respectively. The solder bumps 30-38 are typically formed by metals such as Sn, SnAg, SnAu, or SnPb, but other materials could also be used.

The balanced output from the ASIC comprising the preamplifier are seen on the topside view of FIG. 2: ground (indicated as GND), first differential output (indicated as OUT1), and second differential output (indicated as OUT2). In addition, the topside view indicates the power supply terminal (indicated as VDD) on the ASIC. The solder bumps or pads 11-16 serving as external terminals from the microphone assembly are seen on the bottom side view of FIG. 2. These pads 11-16 serve as external contact points for connection with external equipment and they are adapted for surface mounting. The pads 11-16 may comprise solderable materials, such as a Sn, SnAg, SnAu, SnPb, Au, Pt, Pd, or Cu. On the embodiment shown in FIG. 2 the pads 11-16 have a hexagonal shape, however other shapes may be used. Three of the pads 13,14,15 are used for ground (indicated as GND) even though only one is strictly necessary. However, with respect to mounting stability it is preferred to have more than a total of four pads 11-16. The three pads 11,12,16 are the two balanced output signals (indicated as OUT1, and OUT2) and power supply voltage (indicated as VDD).

Due to the surface mounting technique the number of terminals from the miniature microphone is not important—neither with respect to the amount of space required nor with respect to production facility. Production speed will not to a significant degree be influenced by the presence of more terminals. Hereby the advantages by balanced connections do not suffer from significant disadvantages compared to conventional coupling of miniature microphone assemblies.

Silicon microphones can withstand a high temperature and therefore they are well suited for surface mounting that will give rise to a high temperature of the components during the soldering process involved. Other types of microphone cartridges that enable surface mounting may be used as well.

The embodiment shown in FIG. 2 may be implemented using a silicon carrier substrate 1 with a length of 2.4 mm, a width of 1.35 mm, and a thickness of 0.5 mm.

Several miniature microphone cartridges may be combined on a common carrier substrate to form a miniature MEMS microphone array. As described above, each transducer elements of the array are preferably connected to its individual amplifier providing differential outputs so as to form electrical output signals from each of the transducer element. Preferably, all the microphone cartridges forming the array exhibit similar electro-acoustic characteristics. However, the array may also be formed by groups of microphone cartridges with two or more different sets of electro-acoustic characteristics. In a preferred embodiment of such an array the miniature microphone transducer elements are silicon-based and preferably, as described above, output from the amplifiers are balanced while the transducer elements are single-ended.

The general advantages of using a microphone assembly with a balanced output are primarily less EMI sensitivity and a better power supply (noise) rejection characteristics and other possible interference at the balanced terminals. Furthermore, coupling capacitors to an external system may in some cases be omitted, thus reducing cost of use. For the ever lowering power supply voltages available within miniature equipment, the balancing technique also means doubling of the overload margin. Doubling of the microphone sensitivity is an alternative also possible. These advantages are especially appreciable but not exclusively within telecommunication equipment, such as mobile phones, hearing aids or headsets.

The invention claimed is:

1. Miniature MEMS microphone, comprising a single-ended transducer element adapted to receive incoming acoustic waves and to convert a received incoming acoustic wave to an unbalanced first electrical signal, and an amplifier adapted to receive the first electrical signal, and to generate a differential electrical signal being an amplified version of the first electrical signal, and to provide said differential electrical signal on a pair of terminals arranged on a substantially plane exterior surface part of the miniature MEMS microphone.

2. Miniature MEMS microphone according to claim 1, wherein the single-ended transducer element is mounted on a first surface of a silicon-based carrier substrate, and wherein a second surface of the silicon-based carrier substrate forms the substantially plane exterior surface part.

3. Miniature MEMS microphone according to claim 2, wherein the first surface is substantially plane and substantially parallel to the second surface.

4. Miniature MEMS microphone according to claim 3, wherein the single-ended transducer and the amplifier are integrated on a silicon-based substrate.

5. Miniature MEMS microphone according to claim 2, wherein the amplifier is mounted on the first surface of the silicon-based carrier substrate.

6. Miniature MEMS microphone according to claim 2, wherein the amplifier is monolithically integrated with the silicon-based carrier substrate.

7. Miniature MEMS microphone according to claim 2, wherein the single-ended transducer element is silicon-based.

8. Miniature MEMS microphone according to claim 2, wherein the amplifier is formed on a silicon-based substrate.

9. Miniature MEMS microphone according to claim 1, further comprising a housing having an acoustical inlet opening aligned with the single-ended transducer element.

10. Miniature MEMS microphone according to claim 1, comprising a plurality of single-ended transducer elements adapted to generate unbalanced electrical signals in response to incoming acoustic waves, each of the plurality of unbalanced electrical signals being received by separate amplifiers adapted to provide differential amplified versions of the plurality of unbalanced electrical signals on separate pairs of terminals arranged on the substantially plane exterior surface of the miniature MEMS microphone.

* * * * *